United States Patent [19]

Joseph

[11] 3,969,841

[45] July 20, 1976

[54] BOXING TOY

[75] Inventor: Lancelot Joseph, Lasalle, Canada

[73] Assignee: Lawrence Peska Associates, Inc., New York, N.Y. ; a part interest

[22] Filed: Apr. 7, 1975

[21] Appl. No.: 565,854

[52] U.S. Cl. ..... 46/268; 46/143

[51] Int. Cl.[2] ..... A63H 13/06

[58] Field of Search ..... 46/142, 143, 148, 243 S

[56] References Cited

UNITED STATES PATENTS 876,992 1/1908 Mc Gill ..... 46/142

2,088,510 7/1937 Frasca ..... 46/142

*Primary Examiner*—Russell R. Kinsey

*Assistant Examiner*—Robert F. Cutting

[57] ABSTRACT

Toy apparatus which is provided with includes first and second boxer representations which are disposed in facing relationship. The representations are carried on elongated slides which in turn are carried for selective longitudinal reciprocating movement in general alignment with each other. Means are provided for selectively moving said slides which may alternatively may be manual or electromagnetic.

5 Claims, 4 Drawing Figures

FIG. 1
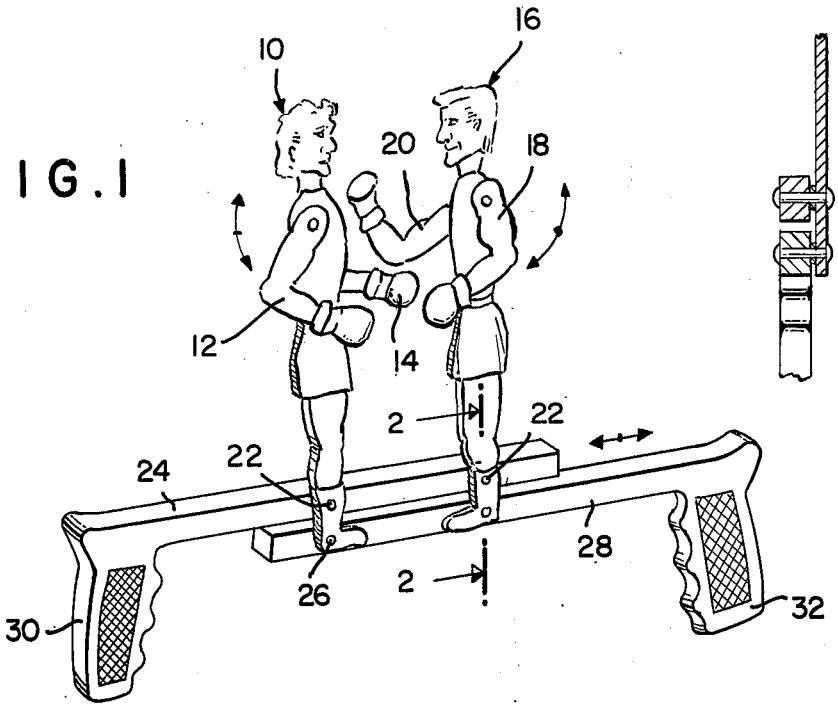
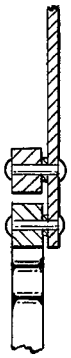
FIG. 2
FIG. 3
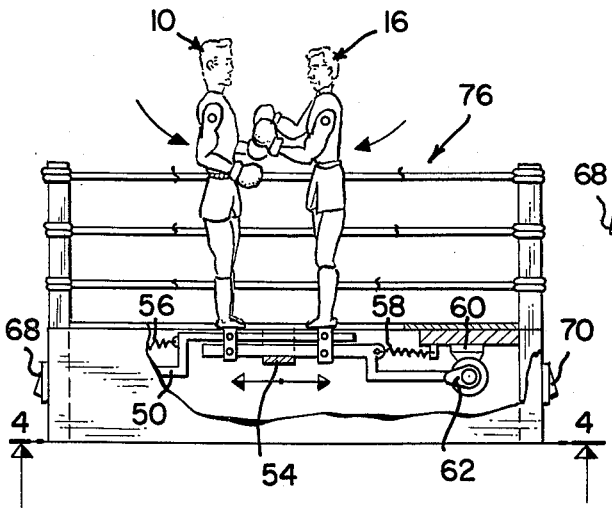
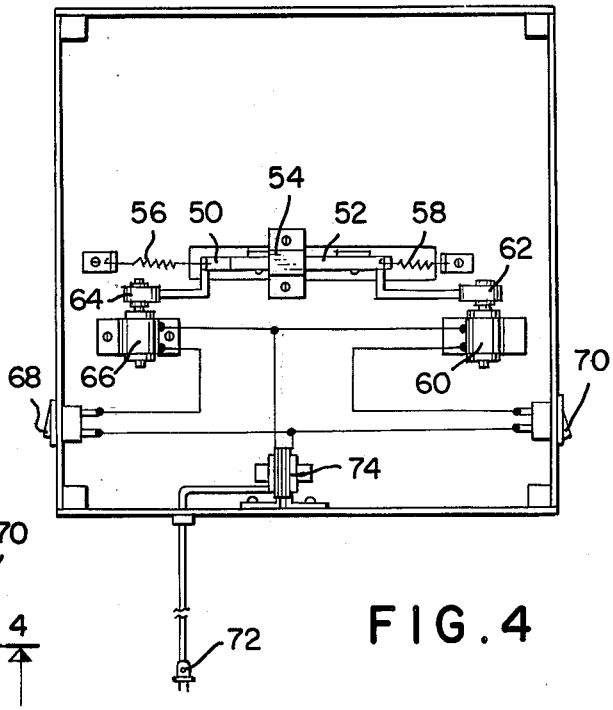
FIG. 4

BOXING TOY

BACKGROUND OF THE INVENTION

The field of the invention relates to toys and particularly to toys having representations of boxers which are selectively moved toward each other. The prior art includes apparatus such as that shown in Ledbetter, U.S. Pat. No. 1,932,317 issued oct. 24, 1933. The apparatus shown therein has not been widely accepted and it is believed that this has been caused by the relatively complexity of the apparatus shown therein.

Accordingly it is the primary object of the invention to provide apparatus which is simple and inexpensive to manufacture and accordingly which can be sold at a competitive price.

Still another object of the invention is to provide apparatus which will be fun to operate and therefore attractive to a variety of consumers.

SUMMARY OF THE INVENTION

The apparatus in accordance with the invention comprises first and second boxer representations which are disposed in facing relationship. Each representation is carried on an elongated slide which is carried for selective longitudinal reciprocating movement. The movement of the two slides is in general aligment of each other and means are provided for selectively moving the slides. In one form the means may be manual and in other forms the means may be electromagnetic. The electromagnetic means may include a spring bias which opposes an eccentric cam driven by an electric motor. The arms of the representations may be pivotally hinged to increase the appearance of movement.

BRIEF DESCRIPTION OF THE DRAWING

The specification concludes with claims particularly pointing out and distinctly claiming the subject matter which I regard as my invention. It is believed the invention will be better understood from the following description taken in conjunction with the accompanying drawing in which:

FIG. 1 is a perspective view of the apparatus in accordance with one form of the invention;

FIG. 2 is a sectional broken away view taken through the line 2—2 of FIG. 1;

FIG. 3 is a side elevational partly broken away view of another embodiment of the invention; and FIG. 4 is a sectional view taken through the line 4—4 of FIG. 3.

DESCRIPTION OF THE PREFERRED EMBODIMENT

Referring now to FIGS. 1 and 2 there is shown apparatus in accordance with one form of the invention. A first representation for FIG. 10 is provided having pivotaling carried arms 12 and 14 carrying another representation of FIG. 16 is disposed in a pose relationship to the first FIG. 10 and is similarly provided with pivotally carried arms 18 and 20. As is apparent from the FIGS. 18 and 20 are pivoted at the shoulder point so that the entire arm which is normally generally L-Shaped may pivot thereabout. As is best seen in FIG. 2 each FIG. 10, is pivotally engaged by a rivet at 2. One of said rivets 22 engages a first elongated slide 24 and the other of said rivets 26 engages a second elongated slide 28. These slides 24, 28 are provided with handle 30, 32.

In operation the handles 30, 32 are grasped by the two opposing players who rapidly urge the elongated slide toward and away from the opposing player. The cooperation of the rivets 22, 26 with the slides 24, 28 and FIGS. 10, 16 produces movement of the FIGS. 18, 20 and an articulation of the arms thereof to produce an authentic looking boxing match representation.

In another form of the invention as shown in FIGS. 3 and 4, FIGS. 10 and 16 are provided as before together with electromechanical means for operation thereof. More particularly slides 50, 52 are provided respectively for movement of the FIGS. 10 and 16. The slides 50, 52 are carried by guide 54 for reciprocal longitudinal movement by guide 54. Springs 56, 58 are provided respectively for urging the slides 50, 52 to the outward positions. Motors 60, 66 and eccentric cam 62, 64 disposed on the shaft thereof are provided for urging the slides 50, 52 inwardly. Normally the apparatus will included switches 68 and 70 for selective operation of the motors and cams by the respective player. The power supply for the motors is provided by line current through a plug 72 and a transformer 74. Ordinarily in this embodiment of the invention a ring generally designated by the numeral 76 is provided disposed around the representations 18, 20.

Various other embodiments will be apparent to those skilled in the art including the use of pivotal connections to merely a single slide as well as the dual connection which is shown in the drawing therein. The scope of my invention should be limited by the appended claims.

Having thus described the invention, what is claimed as new is:

1. A toy comprising first and second boxer representations disposed in facing relationship, each said representation being carried on an elongated slide, each slide being carried for selective longitudinal reciprocating movement in general alignment with each other, said apparatus further including electromechanical means for selectively moving said slides.

2. The apparatus as described in claim 1 wherein said means for selectively moving comprises a spring bias, an eccentric cam opposing said spring bias and means for driving said cam.

3. The apparatus as described in claim 2 wherein said means for driving said cam comprises an electric motor.

4. The apparatus as described in claim 1 wherein each of said representations has pivotally carried arms.

5. The apparatus as described in claim 4 wherein each of said representations is pivotally carried on each of said slides.

* * * * *